US012808557B2

(12) United States Patent
Kim et al.

(10) Patent No.: US 12,808,557 B2
(45) Date of Patent: Nov. 24, 2026

(54) AIR FILTER AND PURIFICATION DEVICE INCLUDING THE SAME

(71) Applicant: Samsung Electronics Co., Ltd., Suwon-si (KR)

(72) Inventors: Sungwon Kim, Suwon-si (KR); Jeeyeon Kim, Suwon-si (KR); Heejin Park, Suwon-si (KR); Joonho Kim, Suwon-si (KR); Changbae Lim, Suwon-si (KR); Yongwon Jeong, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 336 days.

(21) Appl. No.: 18/590,342

(22) Filed: Feb. 28, 2024

(65) Prior Publication Data

US 2024/0288189 A1 Aug. 29, 2024

Related U.S. Application Data

(63) Continuation of application No. PCT/KR2024/002524, filed on Feb. 27, 2024.

(30) Foreign Application Priority Data

Feb. 28, 2023 (KR) ..... 10-2023-0026935
Mar. 3, 2023 (KR) ..... 10-2023-0028513

(51) Int. Cl.
*F24F 8/167* (2021.01)
*F24F 3/14* (2006.01)
(Continued)

(52) U.S. Cl.
CPC ..... *F24F 8/80* (2021.01); *F24F 3/1411* (2013.01); *F24F 8/108* (2021.01); *F24F 8/167* (2021.01);
(Continued)

(58) Field of Classification Search
CPC .... A61L 9/205; A61L 9/20; F24F 3/16; F24F 8/22; F24F 8/167; B01D 53/007;
(Continued)

(56) References Cited

U.S. PATENT DOCUMENTS

2009/0183635 A1 7/2009 Vijayakumar
2010/0135864 A1* 6/2010 Taniguchi ..... B01J 27/135 502/77
(Continued)

FOREIGN PATENT DOCUMENTS

JP H10-085558 A 4/1998
JP H11-207116 A 8/1999
(Continued)

OTHER PUBLICATIONS

Machine Translation of "Toyoda", JP 2016202889 A, cited in the IDS filed Jul. 25, 2025 (Year: 2106).*
(Continued)

*Primary Examiner* — Jennifer Wecker
*Assistant Examiner* — Brady C Pilsbury
(74) *Attorney, Agent, or Firm* — Jefferson IP Law, LLP

(57) ABSTRACT

A purification device is provided. The purification device includes an air filter and/or a light source module. The air filter has a multi-folded form. The air filter includes a first filter layer having electrostatic adsorption capability and/or a second filter layer stacked on one surface of the first filter layer. The second filter layer includes at least one first region including an ultraviolet photocatalytic material and at least one second region including a visible photocatalytic material. The light source module includes at least one ultraviolet light source facing a portion of the first region of the second filter layer and at least one visible light source facing a portion of the second region of the second filter layer.

15 Claims, 10 Drawing Sheets

(51) Int. Cl.

| | |
|---|---|
| ***F24F 8/108*** | (2021.01) |
| ***F24F 8/192*** | (2021.01) |
| ***F24F 8/22*** | (2021.01) |
| ***F24F 8/80*** | (2021.01) |
| ***F24F 13/28*** | (2006.01) |

(52) U.S. Cl.
CPC ..... *F24F 8/192* (2021.01); *F24F 8/22* (2021.01); *F24F 13/28* (2013.01)

(58) Field of Classification Search
CPC ..... B01D 53/885; B01D 2253/108; B01D 2253/25; B01D 2255/20707; B01D 2255/802; B01D 2259/802; B01D 2259/804; B01J 19/123; B01J 21/063; B01J 23/30; B01J 35/39
See application file for complete search history.

(56) References Cited

U.S. PATENT DOCUMENTS

| | | | | |
|---|---|---|---|---|
| 2015/0075384 | A1 | 3/2015 | Park et al. | |
| 2019/0113246 | A1* | 4/2019 | Goswami | A61L 9/205 |
| 2020/0030731 | A1* | 1/2020 | Dhau | B01D 53/0407 |
| 2020/0072528 | A1* | 3/2020 | Buzzi | F25D 17/065 |
| 2021/0299315 | A1* | 9/2021 | Maa | A61L 9/18 |
| 2022/0280923 | A1 | 9/2022 | Ji et al. | |
| 2023/0226248 | A1 | 7/2023 | Kim et al. | |

FOREIGN PATENT DOCUMENTS

| | | | | |
|---|---|---|---|---|
| JP | 2003-116974 | A | 4/2003 | |
| JP | 2008-221111 | A | 9/2008 | |
| JP | 2014-121693 | A | 7/2014 | |
| JP | 2016-202889 | A | 12/2016 | |
| KR | 10-0811094 | B1 | 3/2008 | |
| KR | 10-2012-0113938 | A | 10/2012 | |
| KR | 10-2013-0081330 | A | 7/2013 | |
| KR | 10-2013-0128094 | A | 11/2013 | |
| KR | 10-2020-0075961 | A | 6/2020 | |
| KR | 10-2022-0038227 | A | 3/2022 | |
| KR | 10-2022-0126157 | A | 9/2022 | |
| WO | WO-2007070704 | A2 * | 6/2007 | B03C 3/12 |
| WO | 2019/079281 | A1 | 4/2019 | |

OTHER PUBLICATIONS

International Search Report dated Jun. 12, 2024, issued in International Application No. PCT/KR2024/002524.

* cited by examiner

AIR FILTER AND PURIFICATION DEVICE INCLUDING THE SAME

CROSS-REFERENCE TO RELATED APPLICATION(S)

This application is a continuation application, claiming priority under § 365(c), of an International application No. PCT/KR2024/002524, filed on Feb. 27, 2024, which is based on and claims the benefit of a Korean patent application number 10-2023-0026935, filed on Feb. 28, 2023, in the Korean Intellectual Property Office, and of a Korean patent application number 10-2023-0028513, filed on Mar. 3, 2023, in the Korean Intellectual Property Office, the disclosure of each of which is incorporated by reference herein in its entirety.

TECHNICAL FIELD

The disclosure relates to an air filter and a purification device including the same.

BACKGROUND ART

Various products for hygiene management and cleanliness maintenance have emerged due to environmental degradation such as air pollution caused by high-concentration fine dust and/or yellow dust or water pollution caused by various types of waste and chemical substances, and the problem of infectious diseases including bacteria and viruses. For example, purification devices such as air purifiers and water purifiers have emerged to purify indoor air or drinking water, and the use of purification devices is expanding in all aspects of daily life.

A purification device may include nonwoven or electrostatic filters to capture, adsorb, or remove particles of contaminants, and/or may include activated carbon or metal oxide filters to adsorb, decompose, and deodorize harmful gases, and/or may include UV and metal oxide filters to remove bacteria and/or viruses. For example, while air or drinking water passes through a filter, contaminants and various bacteria, and/or viruses may be removed by the filter. Such a purification device is typically installed in a user's living/office space or various living facilities where a large number of people come and go.

The above information is presented as background information only to assist with an understanding of the disclosure. No assertion is made and no determination has been made, as to whether any of the above might be applicable as prior art with regard to the disclosure.

DETAILED DESCRIPTION OF THE INVENTION

Aspects of the disclosure are to address at least the above-mentioned problems and/or disadvantages and to provide at least the advantages described below. Accordingly, an aspect of the disclosure is to provide an air filter and a purification device including the same.

Additional aspects will be set forth in part in the description which follows and, in part, will be apparent from the description, or may be learned by practice of the presented embodiments.

Technical Solution

According to an embodiment of the disclosure, a purification device is provided. The purification device may include an air filter and a light source module (103; 227). The air filter may have a multi-folded form. The air filter may include a first filter layer having electrostatic adsorption capability and a second filter layer (120) stacked on one surface of the first filter layer. The second filter layer may include at least one first region including an ultraviolet photocatalytic material and at least one second region including a visible photocatalytic material. The light source module may include at least one ultraviolet light source facing a portion of the first region of the second filter layer and at least one visible light source facing a portion of the second region of the second filter layer.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF DRAWINGS

The above and other aspects, features, and/or advantages of an embodiment of the disclosure may become more apparent from the following detailed description taken in conjunction with the accompanying drawings, in which.

Throughout the drawings, like reference numerals will be understood to refer to like parts, components, and structures.

MODE FOR CARRYING OUT THE INVENTION

Figure 1:
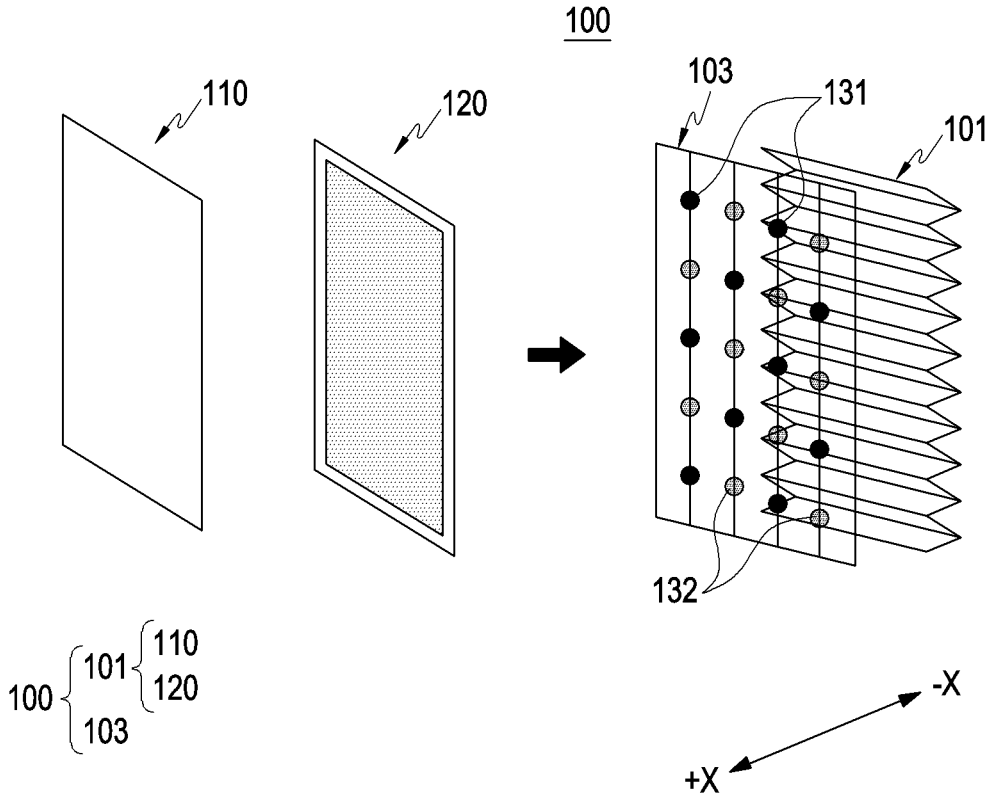
FIG. 1 illustrates a perspective view of an air filter and a light source module according to an embodiment of the disclosure.

The following description with reference to the accompanying drawings is provided to assist in a comprehensive understanding of various embodiments of the disclosure as defined by the claims and their equivalents. It includes various specific details to assist in that understanding, but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but are merely used by the inventor to enable a clear and consistent understanding of the disclosure. Accordingly, it should be apparent to those skilled in the art that the following description of various embodiments of the disclosure is provided for illustration purposes only and not for the purpose of limiting the disclosure as defined by the appended claims and their equivalents.

It is to be understood that singular forms "a", "an", and "the" include plural referents unless the context clearly dictates otherwise. Thus, for example, reference to "a component surface" includes reference to one or more of such surfaces.

The electronic device according to various embodiments may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

It should be appreciated that various embodiments of the disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. As used herein, each of such phrases as "A or B," "at least one of A and B," "at least one of A or B," "A, B, or C," "at least one of A, B, and C," and "at least one of A, B, or C," may include any one of, or all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via a third element.

As used in connection with various embodiments of the disclosure, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC).

Various embodiments as set forth herein may be implemented as software (e.g., the program) including one or more instructions that are stored in a storage medium (e.g., internal memory or external memory) that is readable by a machine (e.g., the electronic device). For example, a processor (e.g., the processor) of the machine (e.g., the electronic device) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a complier or a code executable by an interpreter. The machine-readable storage medium may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program product may be traded as a product between a seller and a buyer. The computer program product may be distributed in the form of a machine-readable storage medium (e.g., compact disc read only memory (CD-ROM)), or be distributed (e.g., downloaded or uploaded) online via an application store (e.g., PlayStore™), or between two user devices (e.g., smart phones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities, and some of the multiple entities may be separately disposed in different components. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

It should be appreciated that the blocks in each flowchart and combinations of the flowcharts may be performed by one or more computer programs which include instructions. The entirety of the one or more computer programs may be stored in a single memory or the one or more computer programs may be divided with different portions stored in different multiple memories.

Any of the functions or operations described herein can be processed by one processor or a combination of processors. The one processor or the combination of processors is circuitry performing processing and includes circuitry like an application processor (AP, e.g. a central processing unit (CPU)), a communication processor (CP, e.g., a modem), a graphical processing unit (GPU), a neural processing unit (NPU) (e.g., an artificial intelligence (AI) chip), a Wi-Fi chip, a Bluetooth® chip, a global positioning system (GPS)

chip, a near field communication (NFC) chip, connectivity chips, a sensor controller, a touch controller, a finger-print sensor controller, a display drive integrated circuit (IC), an audio CODEC chip, a universal serial bus (USB) controller, a camera controller, an image processing IC, a microprocessor unit (MPU), a system on chip (SoC), an integrated circuit (IC), or the like.

Figure 2:
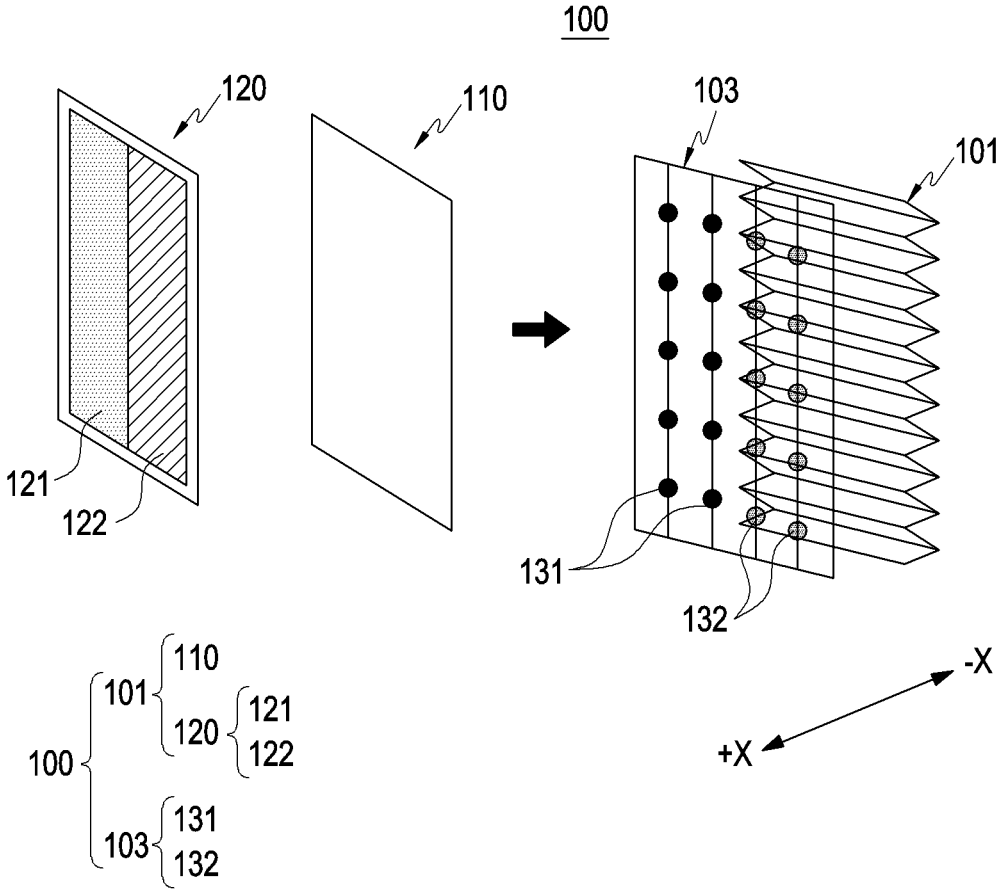
FIG. 2 illustrates a perspective view of an air filter and a light source module according to an embodiment of the disclosure.
Figure 3:
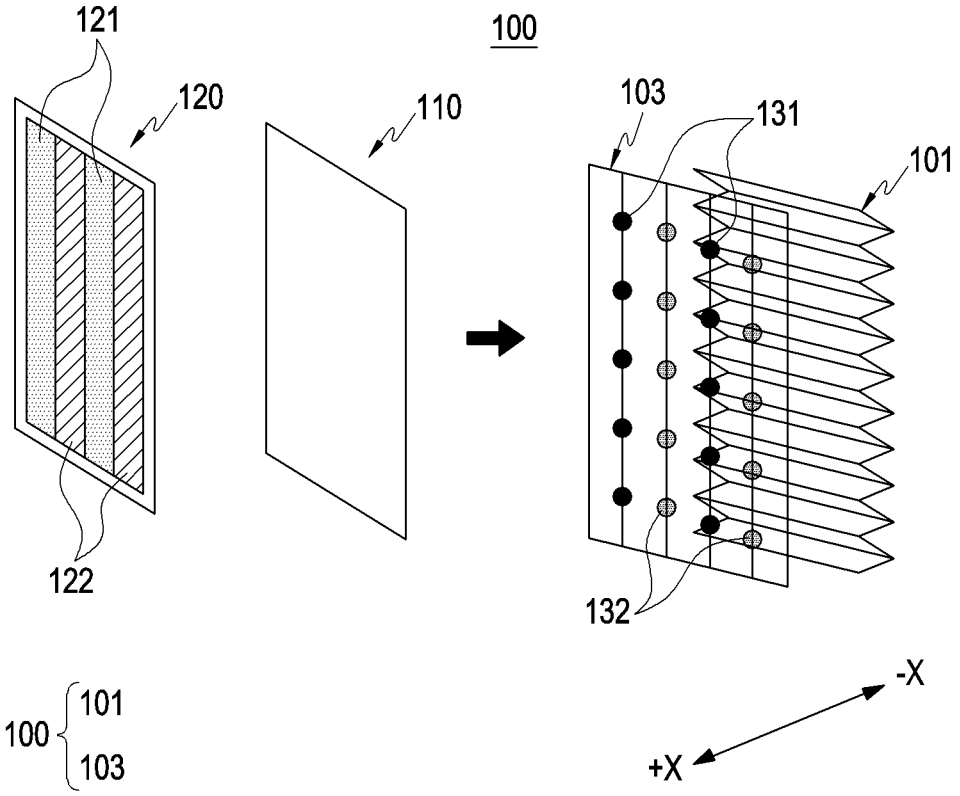
FIG. 3 illustrates a perspective view of an air filter and a light source module according to an embodiment of the disclosure.
Figure 4:
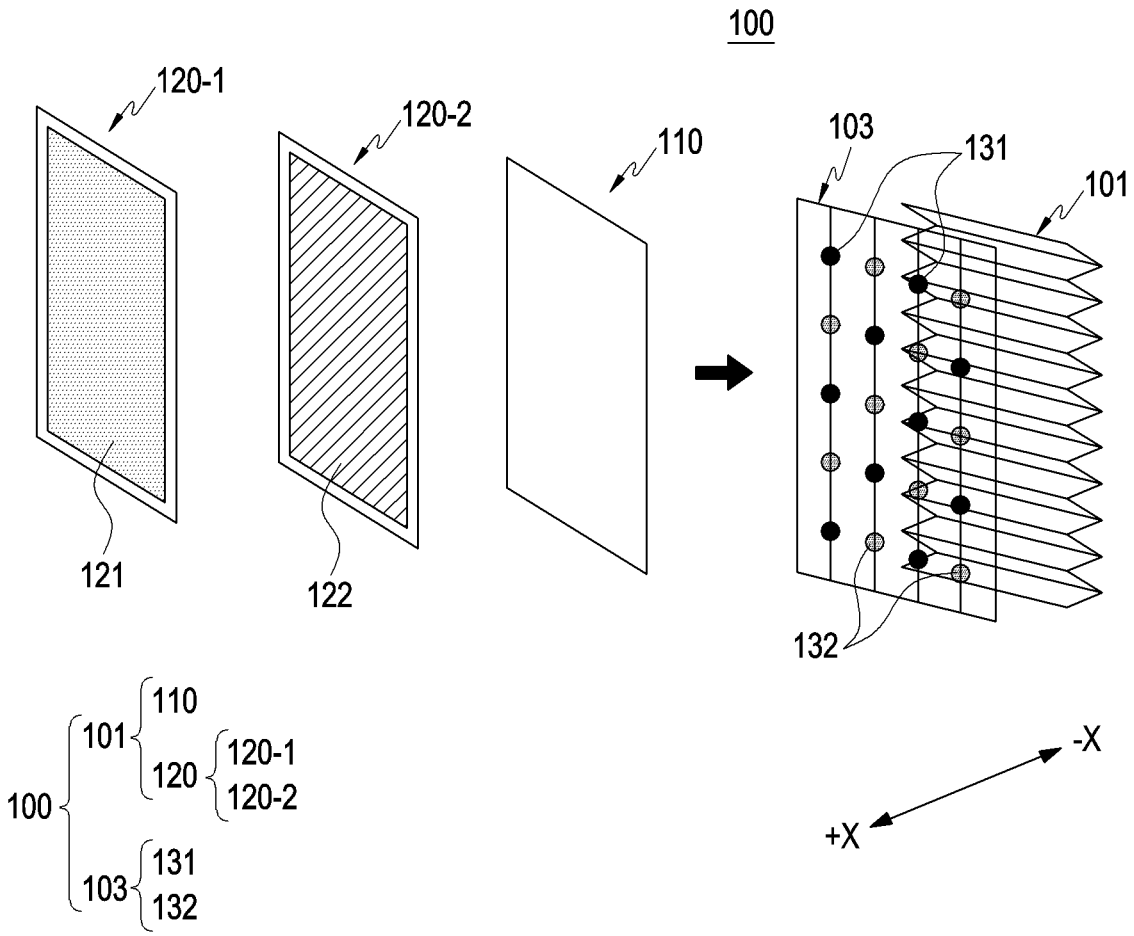
FIG. 4 illustrates a perspective view of an air filter and a light source module according to an embodiment of the disclosure.
Figure 5:
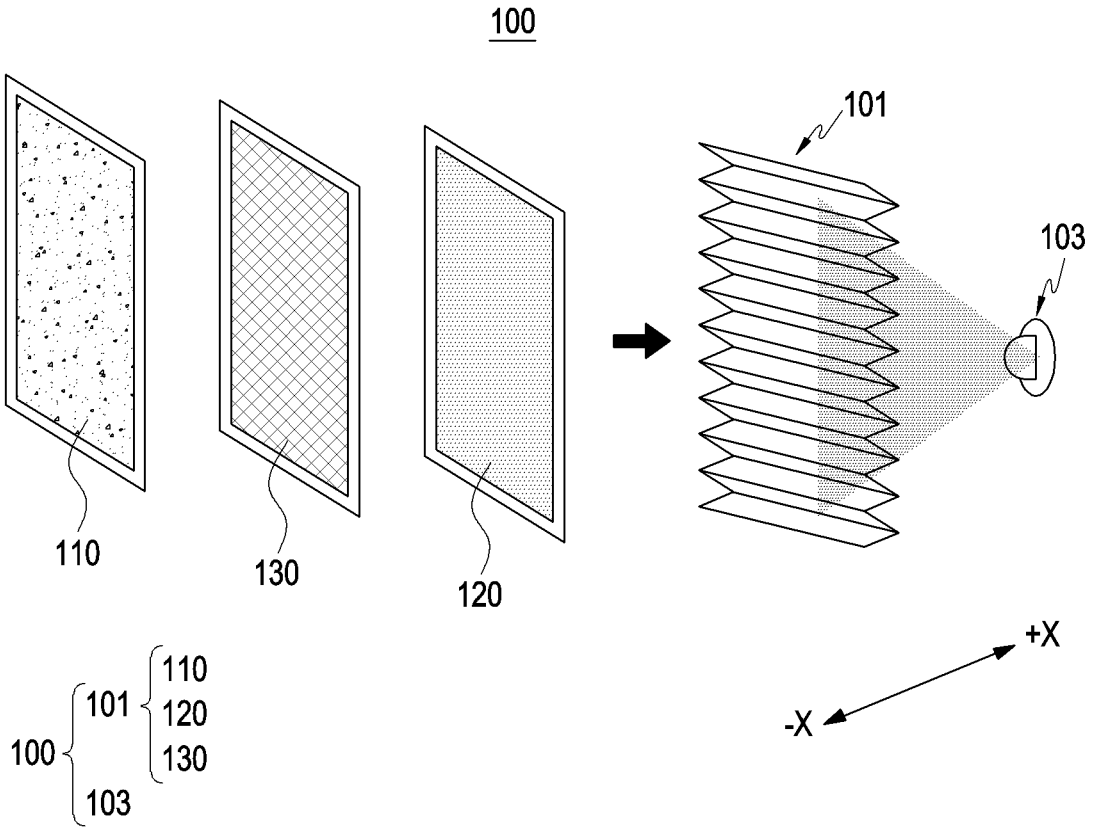
FIG. 5 illustrates a perspective view of an air filter and a light source module according to an embodiment of the disclosure.

FIG. 1 illustrates a perspective view of an air filter and a light source module according to an embodiment of the disclosure. FIG. 2 illustrates a perspective view of an air filter and a light source module according to an embodiment of the disclosure. FIG. 3 illustrates a perspective view of an air filter and a light source module according to an embodiment of the disclosure. FIG. 4 illustrates a perspective view of an air filter and a light source module according to an embodiment of the disclosure. FIG. 5 illustrates a perspective view of an air filter and a light source module according to an embodiment of the disclosure. FIGS. 1 and 2 may conceptually illustrate a light source module, and FIGS. 3 to 5 may schematically illustrate the structure of a light source module and the arrangement relationship between an air filter and the light source module according to an embodiment.

Referring to FIG. 1, in an embodiment, a filter assembly 100 may include an air filter 101 and a light source module 103. The filter assembly 100, according to an embodiment of the disclosure, is a purification device (see FIGS. 6 and 7), such as an air purifier, and may be used in a home appliance that is installed in an interior of a building, such as a home or office, so as to provides a function of purifying air. According to an embodiment, the filter assembly 100 (e.g., air filter 101) may capture or remove dust, moisture, harmful gases, and/or odorous substances floating in the air, and may remove or inactivate bacteria or viruses.

Referring to FIGS. 1 to 5, in an embodiment, the air filter 101 may include a first filter layer 110 and a second filter layer 120. For example, the first filter layer 110 and the second filter layer 120 may be aligned along one axis (e.g., the X axis). According to an embodiment, the air filter 101 may be processed into a designated shape with the first filter layer 110 and the second filter layer 120 integrated. According to an embodiment of the disclosure, the air filter 101 may have a multi-bent shape. For example, the air filter 101 may have a shape with periodically repeated crests and troughs by being bent in a zigzag manner, for example, like a bellows shape. For example, the air filter 101 having a bent shape may have a relatively large surface area in contact with air compared to an unbent air filter 101 having the same size.

According to an embodiment, the first filter layer 110 of the air filter 101 may adsorb or capture particles, dust (e.g., fine dust), or organic compounds in the air. According to an embodiment, the first filter layer 110 may be configured to have electrostatic adsorption capability. For example, the first filter layer 110 may be formed of a polymeric (plastic) material (polyethylene terephthalate (PET), polypropylene (PP), polyethylene (PE), polytetrafluoroethylene (PTFE), or the like). According to an embodiment, the first filter layer 110 may be formed by a melt blown process in which a thermoplastic polymer is melted and extruded through a nozzle. According to an embodiment, the first filter layer 110 may have a light transmittance of about 12% to about 15%.

According to an embodiment, the second filter layer 120 may include a photocatalytic (e.g., ultraviolet photocatalytic and/or visible photocatalytic) material, and may provide a filter function for removing bacteria or viruses. For example, the second filter layer 120 may be disposed on one surface (e.g., an −X direction surface) of the first filter layer 110 and may be fixedly attached, for example, by using a bonding agent or an adhesive. According to an embodiment, the second filter layer 120 may provide support for another filter layer (e.g., the first filter layer 110) and may substantially determine the shape of the air filter 101. For example, the second filter layer 120 may be made of a material including at least one of a breathable mesh, nonwoven fabric, felt, polyethylene terephthalate (PET), or polypropylene (PP), and such material may have a light transmittance of about 50% to about 80%.

According to an embodiment, the photocatalytic material of the second filter layer 120 may include an ultraviolet photocatalytic material and a visible photocatalytic material that are sensitive to ultraviolet light and visible light, respectively. According to an embodiment, the ultraviolet photocatalytic material and the visible photocatalytic material may be evenly distributed in the second filter layer 120. For example, the ultraviolet photocatalytic material and the visible photocatalytic material may be coated on the second filter layer 120. For example, coating may be performed by spraying, on the second filter layer 120, a solution containing a coating material including the photocatalytic material or dipping the second filter layer 120 in a solution in which the coating material is dispersed, followed by heat treatment (coating layer stabilization). However, for example, the ultraviolet photocatalytic material and/or the visible photocatalytic material may be contained in a material constituting the second filter layer 120. For example, the second filter layer 120 may include a photocatalytic (e.g., ultraviolet photocatalytic and/or visible photocatalytic) material in a ratio of about 0.1 to 80 wt % relative to a material containing at least one of a breathable mesh, nonwoven fabric, felt, polyethylene terephthalate (PET), or polypropylene (PP). As will be described below with reference to FIGS. 2 to 4, according to an embodiment, the second filter layer 120 may include a first region 121 including an ultraviolet photocatalytic material and a second region 122 including a visible photocatalytic material.

According to an embodiment, the ultraviolet photocatalytic material of the second filter layer 120 may react with ultraviolet light, emitted from the light source module 103, to remove harmful gases and/or odorous substances. In an embodiment, the ultraviolet photocatalytic material may include a hybrid photocatalyst that combines a photocatalytic component (e.g., titanium dioxide ($TiO_2$)) and an adsorbent material (e.g., zeolite (HZSM-5)). For example, a photocatalytic component may not only completely decompose volatile organic compounds (VOCs) into carbon dioxide and water, which are harmless to a human body, but may also be effective in inactivating (or "antibacterial action") various bacteria or viruses when ultraviolet light is used. For example, the ultraviolet photocatalytic material may remove (or "air purification action") harmful gases or substances from the air, such as nitrogen oxides ($NO_x$), sulfur oxides ($SO_x$), formaldehyde, and the like. In addition, the ultraviolet photocatalytic material may adsorb and/or decompose (or "deodorization action") odor-causing substances such as acetaldehyde, ammonia, and hydrogen sulfide. For example, the photocatalytic component may also decompose pollutants adsorbed on a filter, thereby reducing costs related to filter maintenance and replacement.

According to an embodiment, the photocatalytic component of the ultraviolet photocatalytic material may include at least one of titanium dioxide ($TiO_2$) (in the form of anatase, rutile, or anatase+rutile), tungsten oxide ($WO_3$), or zinc oxide (ZnO). For example, titanium dioxide may produce radicals (e.g., OH) when receiving ultraviolet light, and the radicals may inactivate bacteria or viruses with strong oxidizing power, and may decompose harmful gases and/or odorous substances. According to an embodiment, the gas adsorption component may be hydrophobic, and may include hydrophobic zeolite, for example, at least one of HZSM-5, USY, HY, or Beta zeolite. These hydrophobic gas adsorption components (e.g., zeolite (HZSM-5)) can adsorb hydrophobic odorants and/or hydrophobic harmful gases (e.g., toluene series) that the photocatalyst component (e.g., titanium dioxide) cannot adsorb, and can deliver the same to the photocatalyst component. Thus, the ultraviolet photocatalytic material according to an embodiment of the disclosure can remove hydrophobic gases and/or odorous substances, including hydrophilic ones, thereby improving air purification performance compared to using the photocatalytic component (e.g., titanium dioxide) alone.

According to an embodiment, the ultraviolet photocatalytic material may include a photocatalytic component (e.g., titanium dioxide) and a gas adsorption component (e.g., zeolite (HZSM-5)) in a ratio of about 1:3 to about 3:1, and preferably in a ratio of 1:1. For example, when the ratio of the photocatalytic component to the gas adsorption component is substantially about 1:1, the decomposition performance for hydrophilic and hydrophobic harmful gases may be maximized.

However, the gas adsorption component constituting the ultraviolet photocatalytic material is not limited to the examples described above. For example, the gas adsorption component may include at least one of zeolite, sepiolite, mesoporous silica (SiO2), or activated carbon. For example, the zeolite may also include at least one of a natural zeolite or a synthetic zeolite. The synthetic zeolite may include at least one of A zeolite, X zeolite, Y zeolite, Zeolite Socony Mobile number 5 (ZSM-5) zeolite, or eta zeolite.

According to an embodiment, the visible photocatalytic material of the second filter layer 120 may react with visible light emitted from the light source module 103 to inactivate viruses and bacteria. In an embodiment, the visible photocatalytic material may include a compound of an antibacterial (antiviral) component and a photocatalytic component. For example, the antibacterial component of the visible photocatalytic material may include at least one of copper (Cu), copper oxide, carbon (C), nitrogen (N), or a copper-zinc alloy (CU—Zn). According to an embodiment, the visible photocatalytic material may include a metal such as copper (Cu) or a copper oxide such as CuxO, Cu2O, or CuO, which is sensitive to visible light. For example, the photocatalytic component of the visible photocatalytic material may include at least one of titanium dioxide (TiO2), tungsten oxide (WO3), or zinc oxide (ZnO). For example, the photocatalytic component (e.g., titanium dioxide) may be sensitized to visible light to generate electron-hole pairs. Cu(± may be reduced to Cu(° by combining with the electron generated by the photocatalytic material. For example, Cu(° may oxidize and inactivate bacteria and/or viruses (antibacterial), and then oxidize to Cu(II), which no longer has antibacterial (antiviral) performance. For example, when the visible photocatalytic material is temporarily exposed to visible light and when the total amount of copper in the second filter layer 120 is constant, Cu(± is not reduced, and thus the proportion of Cu(± may increase and the proportion of Cu(° may decrease. For example, when the second filter layer 120 is irradiated with visible light for only a predetermined time, the antibacterial (antiviral) performance of the second filter layer 120 may be maintained even when visible light sources 132 are turned off, until all of the already reduced Cu(° is oxidized to Cu(±. For example, the antibacterial (antiviral) performance of the second filter layer 120 may be restored and maintained by turning on the visible light sources 132 of the light source module 103 for a predetermined time as needed.

In an embodiment, the second filter layer 120 (e.g., a hybrid catalyst) may include an ultraviolet photocatalytic material and a visible photocatalytic material in a designated ratio. According to an embodiment, the designated ratio of the ultraviolet photocatalytic material to the visible photocatalytic material may be from about 19:1 to about 3:1. For example, within the range of the above-designated ratio, antibacterial and/or antiviral performance by the visible photocatalytic material and decomposition or removal performance of harmful gases and/or odorous substances by the ultraviolet photocatalytic material may be secured.

In an embodiment, the first filter layer 110 and/or the second filter layer 120 may include a dehumidification material that absorbs moisture contained in the atmosphere and/or an antibacterial (antiviral) material that inactivates bacteria and/or viruses floating in the air. For example, the dehumidification material may include at least one of silica, silica gel, zeolite, or a metal-organic framework (MOF). For example, the antibacterial material may include a metal component including at least one of copper (Cu), silver (Ag), or zinc (Zn), or a compound of the metal component. For example, the compound of the metal component may include at least one among copper (II) oxide (CuO), copper (I) oxide ($CuO_2$), copper sulfide (CuS), copper chloride ($CuCl_2$), copper sulfate ($CuSO_4$), copper nitrate ($Cu(NO_3)_2$), copper hydroxide ($Cu_2(OH)_3$), silver oxide (AgO), silver nitrate ($AgNO_3$), silver sulfate ($Ag_2SO_4$), zinc oxide (ZnO), or zinc oxide ($ZnO_2$). For example, the antibacterial material may include a metal that reacts with the visible photocatalytic material, such as at least one of copper (Cu), copper (I) oxide (CuO), copper (II) oxide ($CuO_2$), silver (Ag), or zinc oxide (ZnO).

In an embodiment, the light source module 103 may be disposed to emit light to the second filter layer 120. For example, the light source module 103 may face at least a portion of one surface (e.g., a +X-direction surface) of the second filter layer 120. According to an embodiment, the light source module 103 may be disposed more adjacent to the second filter layer 120 than to the first filter layer 110. For example, the light source module 103 and the second filter layer 120 may be arranged to at least partially face each other. According to an embodiment, the light source module 103 may include multiple light sources implemented as elements such as fluorescent lamps or incandescent lamps, or as LEDs. For example, each of the light sources 131 and 132 may include a light-emitting element that outputs light of visible or infrared wavelengths. According to an embodiment, the light source module 103 may include one or more ultraviolet light sources 131 and one or more visible light sources 132. For example, the light source module 103 according to an embodiment of the disclosure may include the ultraviolet light sources 131 and the visible light sources 132 in predetermined proportions to replace some of the high-cost ultraviolet light sources 131 with relatively low-cost visible light sources 132, thereby providing an advantage of cost reduction.

According to an embodiment, multiple ultraviolet light sources 131 and multiple visible light sources 132 may be provided. According to an embodiment, the ratio (e.g., ratio of number, light intensity, and/or surface area) of ultraviolet light sources to visible light sources may be from about 1:3 to about 3:1. For example, the ratio of the ultraviolet light sources 131 to the visible light sources 132 may be about 1:1. For example, the ultraviolet light sources 131 and the visible light sources 132 may be arranged to equally or evenly emit light to one surface (e.g., the −X-direction surface) of the second filter layer 120 that the light sources face, even when only the ultraviolet light sources 131 or the visible light sources 132 are turned on. For example, the separation distance between mutually neighboring ultraviolet light sources 131, between mutually neighboring visible light sources 132, or between an ultraviolet light source 131 and a visible light source 132 neighboring each other may be substantially the same. For example, the neighboring ultraviolet light sources 131 may be substantially spaced at regular intervals, and the visible light sources 132 may each be located between each pair of neighboring ultraviolet light sources 131, wherein the neighboring visible light sources 132 may be substantially spaced at regular intervals.

Referring to FIGS. 2 to 4, in an embodiment, the second filter layer 120 may include a first region 121 including an ultraviolet photocatalytic material and a second region 122 including a visible photocatalytic material. For example, the first region 121 may not include a visible photocatalytic material. The second region 122 may not include an ultraviolet photocatalytic material. For example, the ultraviolet photocatalytic material and the visible photocatalytic material may be coated on the first region 121 and the second region 122 of the second filter layer 120, respectively. For example, coating may be performed by spraying, on the first region 121 and the second region 122 of the second filter layer 120, a solution containing a coating material including the photocatalytic material or dipping the first region 121 and the second region 122 in a solution in which the coating material is dispersed, followed by heat treatment (coating layer stabilization). However, for example, the ultraviolet photocatalytic material and/or the visible photocatalytic material may be contained in a material constituting the second filter layer 120.

Referring to FIGS. 2 to 4, according to an embodiment, the ultraviolet light sources 131 and the visible light sources 132 may be arranged to emit light to the ultraviolet photocatalytic material and the visible photocatalytic material of the second filter layer 120, respectively. For example, multiple ultraviolet light sources 131 and/or multiple visible light sources 132 may be provided. According to an embodiment, the ultraviolet light sources 131 may be disposed to face at least a portion of the first region 121 of the second filter layer 120, in which the ultraviolet photocatalytic material is disposed. The visible light sources 132 may be disposed to face at least a portion of the second region 122 of the second filter layer 120, in which the visible photocatalytic material is disposed. As described above, the photocatalytic materials included in the air filter 101 may react with light emitted from the light sources 131 and 132 to purify air that has been input into the air filter 101.

Referring to FIGS. 2 and 3, in an embodiment, at least one first region 121 and at least one second region 122 may be disposed in a portion of the second filter layer 120 including a single layer, and the second region 122 may be disposed in another portion of the second filter layer 120. For example, the first region 121 and the second region 122 may not overlap each other. According to an embodiment, the at least one first region 121 and the at least one second region 122 may each be disposed in multiple regions into which at least a portion of the second filter layer 120 is divided by at least one axis. Referring to FIG. 2, according to an embodiment, the first region 121 and the second region 122 may be disposed on one side and the other side of one axis (e.g., the longitudinal axis), respectively. Referring to FIG. 3, according to an embodiment, multiple (e.g., two) first regions 121 and multiple (e.g., two) second regions 122 may be alternately arranged with respect to multiple axes (e.g., three axes). Referring to FIGS. 2 and 3, according to an embodiment, the multiple ultraviolet light sources 131 and the multiple visible light sources 132 may be arranged at locations corresponding to the first region 121 and the second region 122, respectively, and for example, may overlap the first region 121 and the second region 122 with respect to one axis (e.g., the X axis). For example, the ultraviolet light sources 131 and the visible light sources 132 may be arranged to form multiple columns and/or multiple rows. Referring to FIGS. 2 and 3, for example, multiple columns of ultraviolet light sources 131 and multiple rows of visible light sources 132 may be disposed at locations corresponding to the first region 121 and the second region 122, respectively.

Referring to FIG. 4, at least one first region 121 and at least one second region 122 may each be disposed in a portion of the second filter layer 120 including multiple (e.g., two) layers. According to an embodiment, the first region 121 and the second region 122 may be disposed in different layers constituting the second filter layer 120. According to an embodiment, the second filter layer 120 may include a (2-1)th filter layer 120-1 and a (2-2)th filter layer 120-2. According to an embodiment, the first region 121 may be disposed on at least a portion of the (2-1)th filter layer 120-1, and the second region 122 may be disposed on at least a portion of the (2-2)th filter layer 120-2. For example, because visible light has greater straightness than ultraviolet light, a catalyst that is sensitive to the visible light may experience a relatively small decrease in catalyst activation with increasing distance from the light sources 131 and 132 compared to a catalyst that is sensitive to ultraviolet light. According to an embodiment, the (2-1)th filter layer 120-1 containing an ultraviolet photocatalytic material may be disposed more adjacent to the light source module 103 than the (2-2)th filter layer 120-2 containing a visible photocatalytic material. For example, the (2-1)th filter layer 120-1 may be disposed between the (2-2)th filter layer 120-2 and the light source module 103. In this case, the activation of the ultraviolet photocatalytic material by the light sources 131 and 132, and air purification and deodorization actions based on the activation may be further facilitated than when the (2-2)th filter layer 120-2 containing a visible photocatalytic material is disposed more adjacent to the light source module 103 than the (2-1)th filter layer 120-1 containing an ultraviolet photocatalytic material. According to an embodiment, multiple ultraviolet light sources 131 and multiple visible light sources 132 may be arranged to evenly emit light to one surface (e.g., the −X direction surface) of each of the (2-1)th filter layer 120-1 and the (2-2)th filter layer 120-2 facing the light source module 103, even when only one type of light sources are turned on. For example, mutually neighboring ultraviolet light sources 131 may be spaced substantially at regular intervals, and the visible light sources 132 may each be located between each pair of mutually neighboring ultraviolet light sources 131, wherein mutually neighboring visible light sources 132 may be spaced substantially at regular intervals.

However, the arrangement of the first region 121 and/or the second region 122 of the second filter layer 120 and the arrangement of the ultraviolet and/or visible light sources 132 are not limited to those described above, but may be in various combinations, and may be altered in consideration of the air purification action and light efficiency of a photocatalyst by the light sources 131 and 132.

Referring to FIG. 5, in an embodiment, the air filter 101 may further include a third filter layer 130 disposed between the first filter layer 110 and the second filter layer 120. For example, the first filter layer 110, the second filter layer 120, and the third filter layer 130 may be integrated by having facing surfaces thereof coupled or attached to each other. For example, the first filter layer 110, the second filter layer 120, and the third filter layer 130 may be aligned along one axis (e.g., the X axis). According to an embodiment, the third filter layer 130 may be made of a material including at least one of a breathable mesh, nonwoven fabric, felt, polyethylene terephthalate (PET), or polypropylene (PP). For example, the third filter layer 130 may substantially provide support to the other filter layers (e.g., the first filter layer 110 and/or the second filter layer 120). For example, the third filter layer 130 may have a light transmittance of from about 50% to about 80%.

In an embodiment, the third filter layer 130 may perform a dehumidification action, an antibacterial action, an air purification action, and/or a deodorization action. According to an embodiment, the third filter layer 130 may include a deodorization material and/or a dehumidification material. For example, the third filter layer 130 may include a dehumidification material and/or an adsorbent material in a ratio of about 1 to 80 wt % relative to a material including at least one of a breathable mesh, nonwoven fabric, felt, polyethylene terephthalate (PET), or polypropylene (PP). For example, the third filter layer 130 may adsorb harmful gases and/or odorous substances that are relatively difficult for the photocatalyst of the second filter layer 120 to decompose. For example, the third filter layer 130 may include an adsorbent material including at least one of zeolite, sepiolite, mesoporous SiO2, or activated carbon. For example, the third filter layer 130 may include a gas adsorption component including at least one of silica, silica gel, zeolite, or a metal-organic framework (MOF). For example, the adsorbent material and/or the gas adsorption component may be coated on the third filter layer 130, or may be contained in a material that at least partially constitutes the third filter layer 130. According to an embodiment, the air filter 101 may further include additional filter layers between the first filter layer 110, the second filter layer 120, and the third filter layer 130. Multiple filters may be integrated by being coupled or attached to each other to form a single air filter 101. In addition, multiple filters may be configured and integrated with each other after each of the multiple filters is processed in a designated shape.

Figure 6:
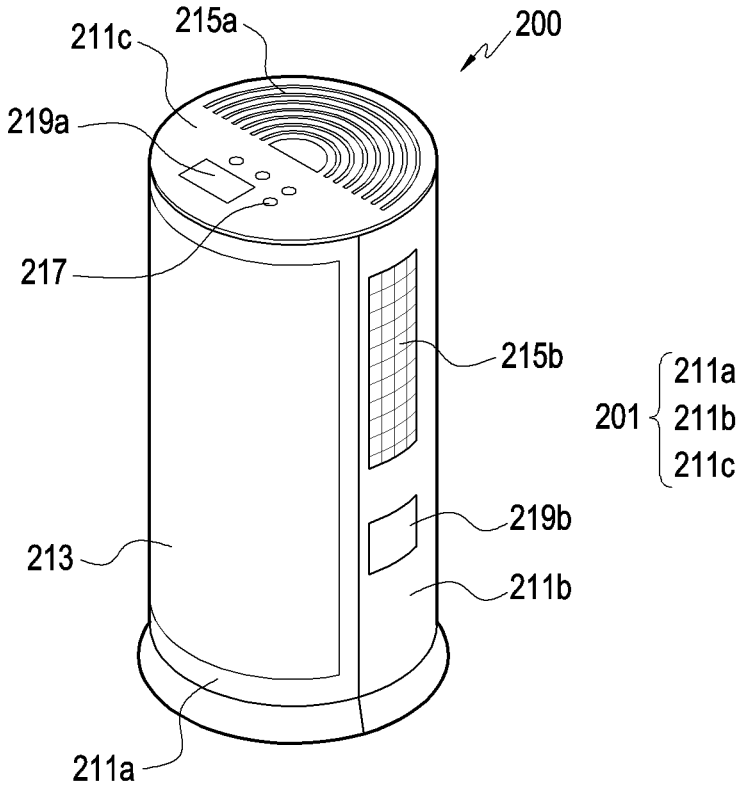
FIG. 6 illustrates an air purifier, which is a purification device employing an air filter assembly according to an embodiment of the disclosure.
Figure 7:
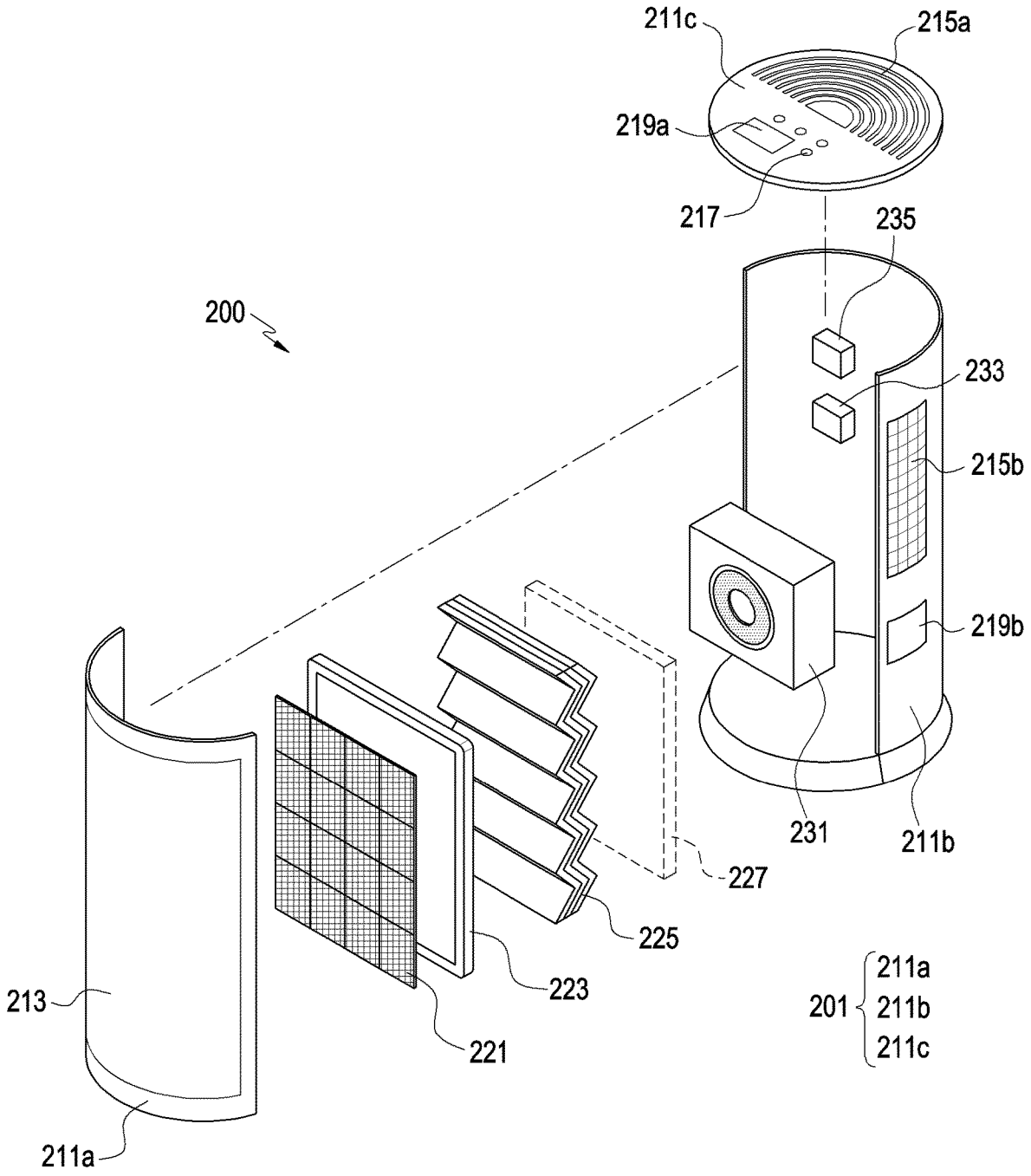
FIG. 7 illustrates an exploded perspective view of the air purifier in FIG. 6 according to an embodiment of the disclosure.

FIG. 6 illustrates an air purifier, which is a purification device employing an air filter assembly according to an embodiment of the disclosure. FIG. 7 illustrates an exploded perspective view of the air purifier in FIG. 6 according to an embodiment of the disclosure.

Referring to FIGS. 6 and 7, a purification device 200 including an air filter assembly (e.g., the air filter assembly 100 in FIGS. 1 to 5) according to an embodiment of the disclosure may be an air purifier, and may include a household appliance that is installed inside a building, such as a home or office, to provide an air purification function. The air purifier may capture or remove dust or gases floating in the air, and may remove or inactivate bacteria or viruses according to an embodiment. The purification device 200 may include a blowing fan 231 to circulate air in the interior space while allowing the air to pass through various filters 221, 223, and 225. According to an embodiment, the purification device 200 may further include a function of adjusting the temperature and humidity of indoor air. For example, the purification device 200 may be a home appliance that includes, or optionally combines, functions of an air purifier, an air conditioner, and/or a humidifier. In an embodiment, the air filter assembly 100 according to an embodiment disclosed herein may be mounted in a water purifier, a refrigerator, a kimchi refrigerator, a washing machine, a dryer, a clothing care device, a shoe rack, a closet, a septic tank, and/or an air conditioning system so as to provide deodorization, antibacterial, and/or antiviral functions.

According to an embodiment, the purification device 200 may include a housing 201 that forms an exterior while providing an inner space, an inlet 213 formed on one side of the housing 201 and configured to suction air, outlets 215*a* and 215*b* for discharging air which has been introduced into the housing 201 and then purified, an input unit 217 for inputting a user command, and display units 219*a* and 219*b* for displaying the operation state of the purification device 200.

According to an embodiment, the housing 201 may include a body 211*b*, a front cover 211*a* couplable to the body 211*b*, and a top cover 211*c*. In the housing 201, some of the above-mentioned elements may be omitted, or one or more other elements may be added. FIG. 7 illustrates a configuration in which the front cover 211*a* or the top cover 211*c* is detachable from the body 211*b*, but the front cover 211*a* or the top cover 211*c* may be integrated with the body 211*b*.

According to an embodiment, the number and locations of the inlets 213 and the outlets 215*a* and 215*b* are not limited to any particular embodiment. FIG. 6 or 7 illustrates that the inlet 213 is formed in the front cover 211*a* of the housing 201 and that first and second outlets 215*a* and 215*b* are formed in the front cover 211*a* and the top cover 211*c*, respectively. However, the disclosure is not necessarily limited thereto.

According to an embodiment, the input unit 217 may include a power button for turning the purification device 200 on or off, a timer button for configuring an operation time for the purification device 200, and a lock button for restricting manipulation of the input unit to prevent mismanipulation of the input unit. In addition, the input unit 217 may include buttons for inputting various types of control information of the purification device 200. In this case, the input unit 217 may be adopted as a push switch that is pressed by a user to generate an input signal, or as a touch switch that is touched by a part of a user's body to generate an input signal. If the input unit 217 adopts the touch switch type, the input unit 217 may be implemented integrally with the display unit 219*a*.

According to an embodiment, the display units 219*a* and 219*b* may display information about the state of the purification device 200. For example, the display units 219*a* and 219*b* may display information about the level of contamination of the filters 221, 223, and 225, information about when the filters 221, 223, and 225 should be replaced or cleaned, information about the state of the filters 221, 223, and 225 (e.g., cumulative use days or cumulative use time), and information about the current state of operation (e.g., information about sensed air quality, blowing speed or direction). In an embodiment, the above-described information may be provided via the display units 219*a* and 219*b*, or via another electronic device (e.g., a smartphone) operating in conjunction with the purification device 200. In an embodiment, the display units 219*a* and 219*b* may be disposed at any location on the housing 201, as long as the location is easily visible to a user. FIG. 6 or 7 illustrates, as the display units 219*a* and 219*b*, the display unit 219*a* disposed on the top cover 211*c* and the display unit 115 disposed on the body 211*b*, but it should be noted that an embodiment disclosed herein is not limited to the configuration illustrated in these drawings.

According to an embodiment, the purification device 200 may include filters, such as a pre-filter 221, a high-efficiency particulate absorbing (HEPA) filter 223, an air filter 225 (e.g., the air filter 101 in FIGS. 1 to 6), and a blowing fan 231. In an embodiment, the purification device 200 may further include a light source module 227 (e.g., the light source module 103 in FIGS. 1 to 5) for emitting light having an infrared wavelength and/or a visible light wavelength. The light source module 227 may be disposed or configured in the interior of the housing 201 so that light source module 227 emits light onto a region (e.g., the first region 121 and/or the second region 122 in FIGS. 2 to 4) of the air filter 225 (e.g., the second filter layer 120 in FIGS. 1 to 5), in which a photocatalytic material is disposed. In an embodiment, the purification device 200 may include a controller 235 for performing operations for driving of the blowing fan 231 and/or emission of the light source module 227 (e.g., recycling of the air filter 225), and may include a first sensor 233 for detecting the quality of air in the purification device 200.

According to an embodiment, the pre-filter 221 is an element for filtering out relatively large dust particles among floating particles or foreign matter in the air, and may be disposed closest to the inlet 213. The HEPA filter 223 may be an element that disposed to the rear side of the pre-filter 221 so as to filter out fine dust, etc. that is not filtered out by the pre-filter 221. In an embodiment, at least a portion (e.g., the first filter layer 110 and the second filter layer 120) of the air filter 225 (e.g., the air filter 101 in FIGS. 1 to 6) may have substantially the same material or structure as the HEPA filter 223. According to an embodiment, the pre-filter 221 may primarily filter dust, and the HEPA filter 223 that has relatively higher performance than the pre-filter 221 may secondarily filter dust. The HEPA filter 223 may be formed of, for example, glass fiber. For example, although not shown, a filter (e.g., the third filter 130 in FIG. 5) including an adsorbent material (e.g., activated carbon) and/or a gas adsorption component may also be included between the pre-filter 221 and the HEPA filter 223 or at the rear side of the HEPA filter 223. The order of arrangement of the filters may follow that illustrated in FIG. 2, but the filters may also be arranged in a different order. Alternatively, any one (e.g., the pre-filter 221 or the HEPA filter 223) of the filters 221, 223, and 225 may be omitted.

In an embodiment, the light source module 227 may be implemented as an LED or an element such as a fluorescent or incandescent lamp. In an embodiment, the light source module 227 may be provided in the form of an assembly such as a lens assembly, such as a Fresnel lens, a convex lens, or a concave lens. According to an embodiment, the controller 235 may control at least one of the following parameters of the light source module 227: brightness, temperature, color, light focusing, emission time, and emission direction. For example, the light source module 227 may be disposed between the air filter 225 and the blowing fan 231, but the arrangement of the light source module 227 is not limited thereto. According to an embodiment (not shown), the light source module 227 may be disposed between the HEPA filter 223 and the air filter 225.

According to an embodiment, the light source module 227 (e.g., the light source module 103 in FIGS. 1 to 5) may emit light in a direction opposite to the direction of air flow to cause a photocatalytic reaction in the filter layer 102. For example, light emitted by the light source module 227 may pass through the air filter 225, e.g., the first filter layer 110 in FIG. 1, and reach the second filter layer 120. According to an embodiment, the light source module 227 may emit light in the direction of air flow in the housing 201. According to an embodiment, the direction in which light is emitted to the air filter 225 may be selected or combined in various ways.

According to an embodiment, the blowing fan 231 may introduce air from outside the purification device 200 into the housing 201 through the inlet 213. The air drawn in by the blowing fan 231 may pass through various filters (the pre-filter 221, the HEPA filter 223, and the air filter 225) and then discharged in a purified state to the outside of the purification device 200 through the outlets 215*a* and 215*b*. The blowing fan 231 may be operated under the control of the controller 235, and may control the flow of air under the control of the controller 235.

According to an embodiment, the first sensor 233 may be a sensor for measuring the quality of air in the purification device 200. For example, the first sensor 233 may be used to measure the type and concentration of substances contained in the air. In an embodiment, the first sensor 233 may be disposed in an inner space of the purification device 200, for example, at a location adjacent to the outlets 215*a* and 215*b* of the purification device 200. Alternatively, the first sensor 233 may be disposed at a location adjacent to the air filter 225 (e.g., the second filter layer 120 in FIGS. 1 to 5) in an inner space of the purification device 200. The first sensor 233 may be of various types. For example, the first sensor 233 may be a gas sensor driven by various methods, including semiconductor-based, diffusion-based, automatic suction-based, electrochemical, contact combustion-based, and optical methods. For example, the purification device 200 may use the first sensor 233 to detect a variety of gases, including hydrogen sulfide (H2S), sulfur dioxide (SO2), hydrogen cyanide (HCN), carbon monoxide (CO), chlorine (Cl2), nitrogen dioxide (NO2), ammonia (NH3), chlorine dioxide (ClO2), ozone (O3), and volatile organic compounds (VOCs).

According to an embodiment, the controller 235 is configured to control the overall operation of the purification device 200. For example, the controller 235 may control the driving of the light source module 227 (e.g., the light source module 103 in FIGS. 1 to 5) and the blowing fan 231.

According to an embodiment disclosed herein, the controller 235 may determine the quality of air based on air quality-related data provided by the first sensor 233 and an external electronic device (e.g., a smartphone or a smart home hub), and control the light source module 227 and/or the blowing fan 231 based on the determined air quality. In the disclosure, the controller 235 may be referred to by terms such as "processor". For example, the controller 235 may execute a program (software) to control at least one other element (e.g., a hardware or software element) of the purification device 200 connected to the controller 235, and may perform various types of data processing or calculation. According to an embodiment, as at least part of the data processing or calculation, the controller 235 (or the processor) may load commands or data received from another element (e.g., a sensor or a communication module) into volatile memory, may process the commands or the data stored in the volatile memory, and may store the resulting data in non-volatile memory. For example, the controller 235 may include a CPU (or digital signal processor (DSP), MPU, etc.), random access memory (RAM), read only memory (ROM), and a system bus. The controller 235 may be implemented as a microcomputer (MICOM), an application-specific integrated circuit (ASIC), or the like.

According to an embodiment, the controller 235 may implement an "air purification mode" and a "filter regeneration mode" of the purification device 200 based on user input, or automatically based on a preset algorithm. Here, the air purification mode of the purification device 200 is a mode in which both the light source module 227 and the blowing fan 231 are active, and may be an operation mode in which the light source module 227 emits light toward the air filter 225 (e.g., the second filter layer 120 in FIGS. 1 to 5) and the blowing fan 231 introduces air from outside the purification device 200 into the purification device 200 to purify the outside air. Here, the filter regeneration mode of the purification device 200 may be, for example, a mode in which the blowing fan 231 is non-active and the light source module 227 is activated so that the light source module 227 emits light toward the air filter 225 (e.g., the second filter layer 120 in FIGS. 1 to 5) to remove contaminants from the filter.

According to an embodiment, the "air purification mode" of the purification device 200 may be subdivided into a "basic mode (or energy saving mode)", an "antibacterial enhancement mode", a "deodorization enhancement mode", and/or a "turbo mode" depending on whether an ultraviolet light source (e.g., the ultraviolet light sources 131 in FIGS. 2 to 4) and/or a visible light source (e.g., the visible light sources 132 in FIGS. 2 to 4) of the light source module 227 (e.g., the light source module 103 in FIGS. 1 to 5) is turned on or off. The above modes may be executed automatically by the processor or by a user's command input through an input unit (e.g., the input unit 217 in FIGS. 6 and 7), in consideration of the need for antibacterial and/or deodorizing action and the need for energy saving.

According to an embodiment, the "basic mode" of the purification device 200 may be a mode in which the blowing fan 231 is active and the light source module 227 is turned off. For example, in the basic mode, air purification, antibacterial action, and/or deodorization action against substances generated by the activity of a photocatalyst, such as residual radicals or reduced metals, may continue for a predetermined time. For example, when operation of the basic mode of the purification device 200 is terminated, the ultraviolet light sources 131 and/or the visible light sources 132 may be turned on for a designated time to restore the performance of the second filter layer 120 (e.g., the second filter layer 120 in FIGS. 1 to 5). According to an embodiment, the "antibacterial enhancement mode" of the purification device 200 may be a mode in which the blowing fan 231 is active and all of the visible light sources 132 of the light source module 227 (e.g., the visible light sources 132 in FIGS. 2 to 4) are on and all of the ultraviolet light sources (e.g., the ultraviolet light sources 131 in FIGS. 2 to 4) are off. In the antibacterial enhancement mode of the purification device 200, as visible light is emitted onto the second filter layer 120, the activity of a visible photocatalyst may increase, and the antibacterial (antiviral) action may be enhanced. For example, when the operation of the antibacterial enhancement mode of the purification device 200 is terminated, the ultraviolet light sources 131 may be turned on for a designated time to restore the deodorization performance of the second filter layer 120.

According to an embodiment, the "deodorization enhancement mode" of the purification device 200 may be a mode in which the blowing fan 231 is active, all of the ultraviolet light sources (e.g., the ultraviolet light sources 131 in FIGS. 2 to 4) of the light source module 227 are turned on, and all of the visible light sources 132 (e.g., the visible light sources 132 in FIGS. 2 to 4) are turned off. In the deodorization enhancement mode of the purification device 200, as the second filter layer 120 is irradiated with ultraviolet light, the activity of the ultraviolet photocatalyst may increase, and the deodorization action may be enhanced. For example, when the operation of the deodorization enhancement mode of the purification device 200 is terminated, the visible light sources 132 may be turned on for a designated time to regenerate the antibacterial (antiviral) action of the second filter layer 120. According to an embodiment, the "turbo mode" of the purification device 200 may be a mode in which the blowing fan 231 is active, and the ultraviolet light sources 131 and the visible light sources 132 of the light source module 227 may be turned on. In the deodorization enhancement mode of the purification device 200, as the second filter layer 120 is irradiated with both ultraviolet light and visible light, the activity of both the ultraviolet photocatalyst and the visible photocatalyst may be increased, and both deodorization and antibacterial (antiviral) action may be enhanced.

According to an embodiment of the disclosure, it should be noted that the air purification mode and the filter regeneration mode may entail, in addition to the activation and operation of the above-described elements, the activation of other elements and the execution of operations using those elements.

Figure 8:
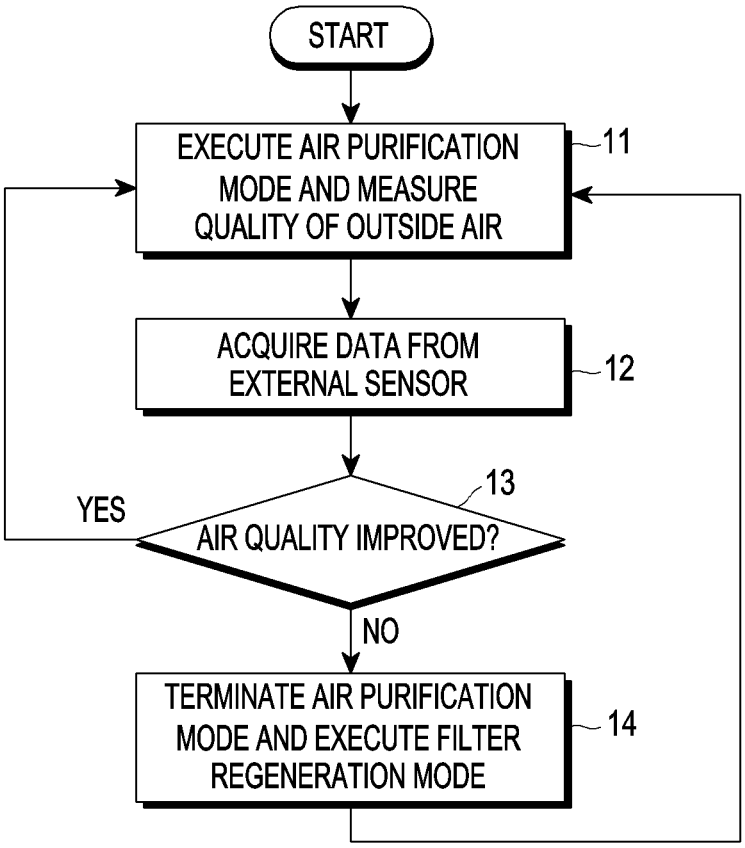
FIG. 8 is a flowchart of a procedure for determining whether to execute a filter regeneration mode while a purification device is in an air purification mode according to an embodiment of the disclosure.

FIG. 8 is a flowchart of a procedure for determining whether to execute a filter regeneration mode while a purification device according to an embodiment of the disclosure is in an air purification mode.

Figure 9:
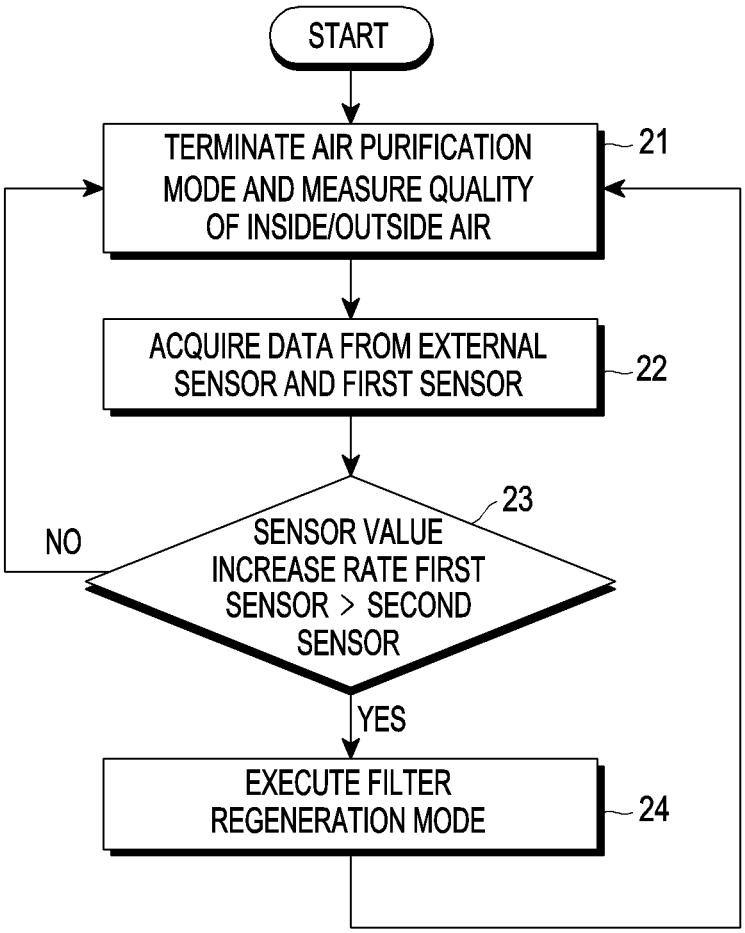
FIG. 9 is a flowchart of a procedure for determining whether to execute a filter regeneration mode when an air purification mode of a purification device is terminated according to an embodiment of the disclosure.

FIG. 9 is a flowchart of a procedure for determining whether to execute a filter regeneration mode when an air purification mode of a purification device according to an embodiment of the disclosure is terminated.

Figure 10:
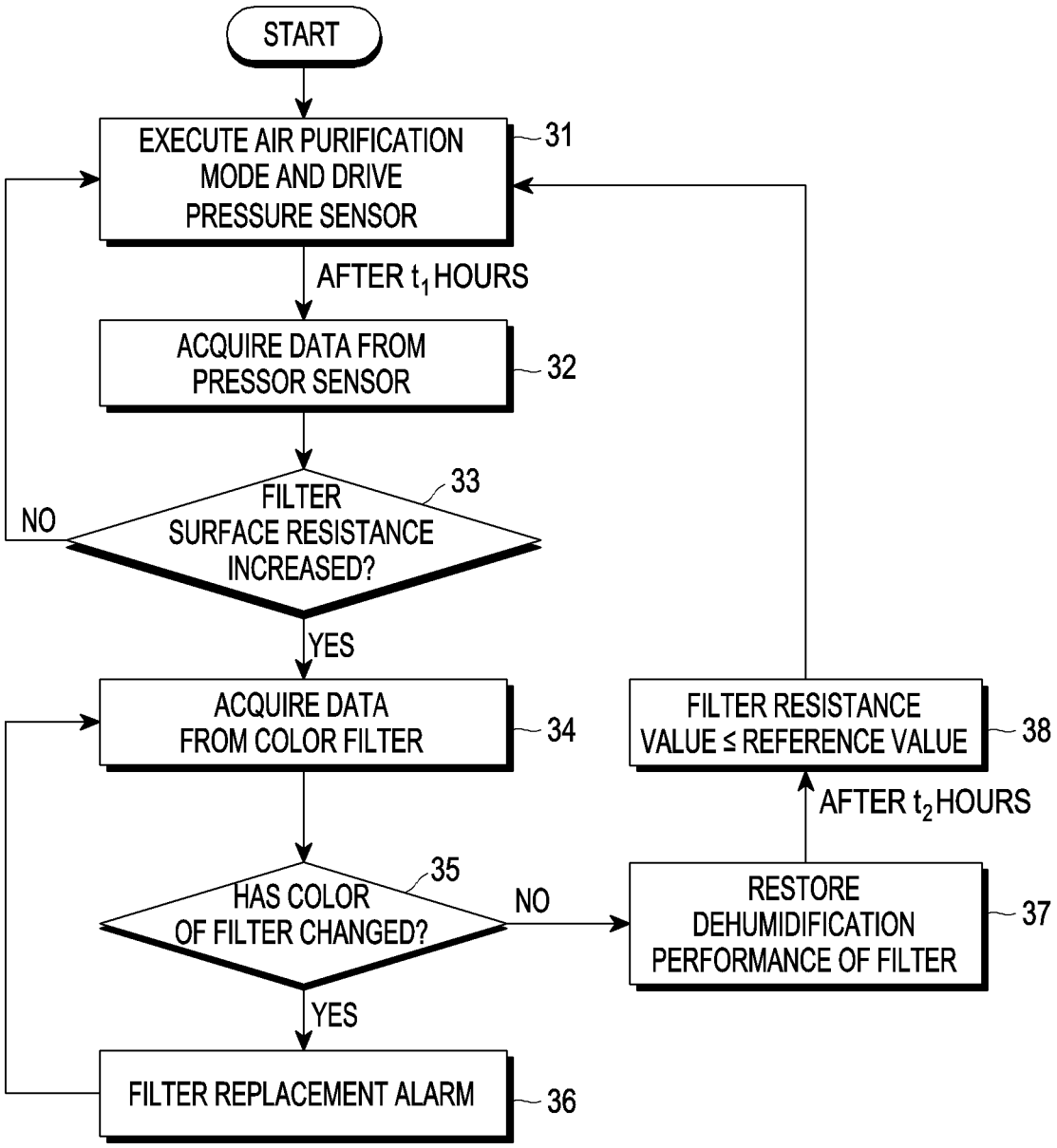
FIG. 10 is a flowchart of a procedure for determining whether to replace a filter while a purification device is in an air purification mode according to an embodiment of the disclosure.

FIG. 10 is a flowchart of a procedure for determining whether to replace a filter a purification device according to an embodiment of the disclosure is in while an air purification mode.

The embodiments described with reference to FIGS. 8 to 10 may be implemented using the air filter assembly 100 in FIGS. 1 to 5 and the purification device 200 in FIGS. 6 and 7, which includes the same.

Referring to FIG. 8, according to an embodiment, in connection with operation 11, in "air purification mode" of the purification device 200, an external sensor (not shown) may be activated. The external sensor is a gas sensor and may detect harmful gases and/or odorous substances in the air. For example, the external sensor (not shown) may be disposed in an external electronic device (e.g., a smartphone or a smart home hub) or may be disposed on a portion of a housing of the purification device. External sensors (not shown) may be of various types. For example, the external sensors may be gas sensors driven by a variety of methods, including semiconductor-based, diffusion-based, automatic suction-based, electrochemical, contact combustion-based, and optical methods. For example, the purification device 200 may use external sensors (not shown) to detect various gases, including hydrogen sulfide (H2S), sulfur dioxide (SO2), hydrogen cyanide (HCN), carbon monoxide (CO), chlorine (Cl2), nitrogen dioxide (NO2), ammonia (NH3), chlorine dioxide (ClO2), ozone (O3), and volatile organic compounds (VOCs). For example, the "air purification mode" of the purification device 200 may be a mode in which both the light source module 103 (e.g., the light source module 103 in FIGS. 1 to 5 and the light source module 227 in FIGS. 6 and 7) and the blowing fan (e.g., the blowing fan 231 in FIGS. 6 and 7) are active, as described above.

In operation 12, for example a processor (e.g., the controller 235 in FIGS. 6 and 7) of the purification device may receive data regarding air quality from the external sensor. In operation 13, for example, the processor (e.g., the controller 235 in FIGS. 6 and 7) may determine, based on the data provided by the external sensor, the concentration, the rate of decrease, and/or the rate of increase of a harmful gas and/or an odorant substance. In operation 14, for example, when the concentration of the harmful gas and/or odorous substance is not reduced, for example, when the rate of decrease is less than a lower limit, the processor may terminate operation of the air purification mode of the purification device and initiate a "filter regeneration mode" of the purification device. For example, when the operation of the purification device is terminated, the processor may turn on an ultraviolet light source (e.g., the ultraviolet light sources 131 in FIGS. 2 to 4) and/or a visible light source (e.g., the visible light sources 132 in FIGS. 2 to 4) of a light source module (e.g., the light source module 103 in FIGS. 1 to 5) for a predetermined time to regenerate a photocatalytic material contained in an air filter (e.g., the air filter 101 in FIGS. 1 to 5).

Referring to FIG. 9, according to an embodiment, in operation 11, in an air purification mode of the purification device 200, a first sensor (e.g., the first sensor 233 in FIGS. 6 and 7) may be active, and the first sensor 233 may be used to measure the quality of air in the purification device. For example, in the air purification mode of the purification device 200, a light source module (e.g., the light source module 103 in FIGS. 1 to 5 and the light source module 227 in FIGS. 6 and 7) and the blowing fan (e.g., the blowing fan 231 in FIGS. 6 and 7) may both be active, as described above.

Referring to FIG. 9, in an embodiment, the purification device may further include a second sensor (not shown) disposed in the housing. The second sensor may be a gas sensor, and may be configured to measure the quality of air in the purification device. According to an embodiment, the second sensor may be disposed on or adjacent to the air filter 101 so as to measure the quality of air on the surface of the air filter 101. For example, the second sensor may be configured to transmit measurement data to the processor (e.g., the controller 235 in FIGS. 6 and 7). Referring to FIG. 9, when the purification device is shut down, the second sensor may be operated to measure the quality of air on the surface of the air filter 101 (e.g., harmful gases and/or odorous substances present on the surface of the air filter 101). According to an embodiment, when the purification device is shut down, the first sensor (e.g., the first sensor 233 in FIGS. 6 and 7) for measuring the quality of air outside the purification device may also be operated. For example, the processor may receive data from the first sensor 233 and the second sensor, and may compare the rates of increase in sensor values of the two sensors. For example, when the rate of increase in a sensor value of the first sensor 233 is greater than that of the second sensor, the air purification performance and/or deodorization performance of the air filter 101 is effective, but harmful gases and/or odorous substances may remain on the surface of the air filter 101. According to an embodiment, when it is determined that the rate of increase in a sensor value of the first sensor 233 is greater than that of the second sensor, the processor may regenerate a photocatalytic material contained in an air filter (e.g., the air filter 101 in FIGS. 1 to 5) to regenerate the air filter 101. According to an embodiment, the processor may turn on an ultraviolet light source (e.g., the ultraviolet light sources 131 in FIGS. 2 to 4) and/or a visible light source (e.g., the visible light sources 132 in FIGS. 2 to 4) of the light source module (e.g., the light source module 103 in FIGS. 1 to 5) for a predetermined time to regenerate the photocatalytic material. For example, after filter regeneration, the above process may be repeated until the processor determines that the rate of increase in a sensor value of the first sensor 233 is not greater than that of the second sensor. According to an embodiment, when it is determined that the rate of increase in the sensor value of the first sensor 233 is not greater than that of the second sensor, the processor may completely terminate the operation of the purification device.

Referring to FIG. 10, in operation 31, in an embodiment, while the purification device 200 is in an air purification mode, a pressure sensor (not shown) may be driven. According to an embodiment, the pressure sensor may measure a resistance value or a change in resistance value of the surface of the air filter 225. For example, the pressure sensor may be disposed in the housing 201 or disposed on the surface of the air filter 225. For example, the pressure sensor may include at least one piezoelectric element disposed on the surface of the air filter 225. For example, the pressure sensor may have a measurement range including 0 to 10 ppm, and may be driven by a variety of methods, including semiconductor-based, electrochemical, contact combustion-based, and optical methods. In relation to operation 32, the pressure sensor may be communicably connected to a processor (e.g., the controller 235 in FIG. 7) and may transmit, to the processor, data regarding a surface resistance value or a change in resistance value (or "data from the pressure sensor"). For example, the pressure sensor may transmit data to the processor periodically or non-periodically, for example, when a resistance value or a change in resistance value is equal to or greater than a designated value, or by a user's command input into an input unit (e.g., the input unit 217 in FIGS. 6 and 7). The processor may periodically or non-periodically receive data from the pressure sensor of the air filter 225.

In operation 33, the processor may determine, based on the data from the pressure sensor, whether the resistance value or the change in resistance value of the surface of the air filter 225 (or "filter surface") has increased to the designated value or more (or "increased resistance"). For example, when the resistance of the filter surface has not increased, e.g., to the designated value or more, the purification device 200 may return to operation 31 because there is no need to replace the air filter 225 and/or restore the dehumidification performance of the air filter 225.

In operation 34, when the resistance of the filter surface has increased, the purification device 200 may receive data from a color sensor (not shown). For example, the color sensor may measure the color and/or color change of the air filter 225 or the surface thereof. For example, the color sensor may be disposed in the housing 201, or on or adjacent to the surface of the air filter 225. For example, the color filter may include at least one light-emitting element and/or at least one light-receiving element. For example, the color sensor may detect light having visible and/or ultraviolet wavelengths, and may be driven by various methods, including semiconductor-based, electrochemical, contact combustion-based, and optical methods. For example, the color sensor may be communicably connected to the processor (e.g., the controller 235 in FIG. 7) and may transmit, to the processor, data regarding a color and/or color change of the air filter 225 or the surface thereof (or "data from the color filter"). In operation 35, the processor may determine a color change and/or contrast change of the air filter 225 or the surface thereof (or "filter surface") based on the data from the color filter.

For example, in operation 36, when it is determined that, in the color change, the color of the filter surface has darkened to the designated value or more, the purification device 200 may display a filter replacement alarm indicating that it is time to replace the air filter 225. For example, it may be inferred from the color change of the filter that contaminants (e.g., dust, organic compounds, harmful gases, and/or odorous substances) are excessively accumulated in the air filter 225. For example, the filter replacement alarm may be transmitted as an audible alarm to an audio device of an external electronic device (e.g., a smartphone) or the purification device 200 or, and/or may be visible on a display unit (e.g., the display unit 219*a* and 219*b* in FIGS. 6 and 7) of the purification device 200 or an external electronic device (e.g., a smartphone).

In operation 37, when it is determined that there is no change in the color of the filter, an operation for regenerating dehumidification performance of the air filter may be performed. For example, it may be inferred that an increase in resistance of the filter surface, without any change in the color of the filter, is not due to contaminants (e.g., dust, organic compounds, harmful gases, and/or odorous substances) accumulated in the air filter 225, but rather due to moisture that has been contained in the air filter 225 due to a dehumidification material. Thus, the resistance value of the filter may be lowered by regenerating only the dehumidification performance of the air filter 225 without replacing the air filter 225. For example, the purification device 200 may restore dehumidification performance by turning on at least part of a light source module (e.g., the light source module 103 in FIGS. 1 to 5 and/or the light source module 227 in FIGS. 6 and 7) to evaporate moisture contained in the air filter by using radiant heat. In operation 38, when the resistance value of the air filter 225 received from the pressure sensor is equal to or less than a reference value, the purification device 200 may terminate the operation for regenerating the dehumidification performance of the filter and return to operation 31.

For example, the purification device 200 may use a conductive air filter 225 to measure changes in electrical properties (e.g., conductivity and/or resistance) of the air filter 225, and may determine, based on the changes, that it is time to restore the dehumidification performance of the air filter 225. For example, the conductive air filter 225 of the purification device 200 may include a conductive material (e.g., Ni-MOF) and a dehumidification material (e.g., silica gel or metal-organic framework) in some filter layers. For example, the purification device 200 may use a piezoelectric element attached to or coated on the air filter 225 to measure an increase in pressure due to the accumulation of contaminants (e.g., fine dust) on the air filter 225 and determine that it is time to replace the air filter 225.

A purification device 200, according to an embodiment of the disclosure, may include an air filter 101; 225 and/or a light source module 103; 227. The air filter may have a multi-folded form. The air filter may include a first filter layer 110 having electrostatic adsorption capability and/or a second filter layer 120 stacked on one surface of the first filter layer. The second filter layer may include at least one first region 121 including an ultraviolet photocatalytic material and at least one second region 122 including a visible photocatalytic material. The light source module may include at least one ultraviolet light source 131 facing a portion of the first region of the second filter layer and at least one visible light source 132 facing a portion of the second region of the second filter layer.

In an embodiment, the ratio of the ultraviolet photocatalytic material of the at least one first region of the second filter layer to the visible photocatalytic material of the at least one second region of the second filter layer ranges from 19:1 to 3:1.

In an embodiment, the ultraviolet photocatalytic material of the at least one first region of the second filter layer may include a photocatalytic component including at least one of titanium dioxide (TiO2), tungsten oxide (WO3), or zinc oxide (ZnO), and a hydrophobic gas adsorption component.

In an embodiment, the gas adsorption component may include at least one of HZSM-5, USY, HY, or Beta zeolite.

In an embodiment, the ratio of the photocatalytic component to the gas adsorption component may be from 1:3 to 3:1.

In an embodiment, the visible photocatalytic material of the at least one second region of the second filter layer may include a compound of a photocatalytic component including at least one of titanium dioxide (TiO2), tungsten oxide (WO3), or zinc oxide (ZnO), and an antibacterial component including at least one of copper (Cu), copper oxide, carbon (C), nitrogen (N), or a copper-zinc alloy (CU—Zn).

In an embodiment, the first filter layer may be formed by extruding a thermoplastic polymeric material. The polymeric material may include a material including at least one of polyethylene terephthalate (PET), polypropylene (PP), polyethylene (PE), or polytetrafluoroethylene (PTFE).

In an embodiment, the second filter layer may include a material including at least one of a nonwoven fabric, felt, polyethylene terephthalate (PET), or polypropylene (PP).

In an embodiment, the at least one first region and the at least one second region may be disposed not to overlap each other in a single layer of the second filter layer.

In an embodiment, the second filter layer may include multiple filter layers. Each of the at least one first region of the second filter layer and the at least one second region of the second filter layer may be disposed on at least partially at least one of multiple filter layers of the second filter.

In an embodiment, the second filter layer may include a (2-1)th filter layer (120-1), wherein at least one first region of the second filter layer disposed in the (2-1)th filter layer and a (2-2)th filter layer (120-2), wherein at least one second region of the second filter layer disposed in the (2-2)th filter layer. The (2-1)th filter layer may be more adjacent to the light source module than the (2-2)th filter layer.

In an embodiment, ultraviolet light source may comprise a plurality of ultraviolet light sources and the visible light source may comprise a plurality of visible light sources. The ratio of the plurality of ultraviolet light sources to the plurality of visible light sources ranges from 1:3 to 3:1.

In an embodiment, at least one of the first filter layer or the second filter layer may include at least one of an antibacterial material, which includes a metal component including at least one of copper (Cu), silver (Ag), or zinc (Zn), or a compound of the metal component, or a dehumidification material, which includes at least one of silica, silica gel, zeolite, or a metal-organic framework (MOF).

In an embodiment, the air filter may further include a third filter layer 130 disposed between the first filter layer and the second filter layer.

In an embodiment, the third filter layer may include: an adsorbent material, which includes at least one of zeolite, sepiolite, mesoporous SiO2, or activated carbon; or a gas adsorption component including at least one of silica, silica gel, zeolite, or a metal-organic framework (MOF).

In an embodiment, the purification device may include a housing 201 configured to accommodate the air filter and the light source module, and a blowing fan 231 disposed in the housing and configured to introduce outside air into the housing through the air filter.

An air filter assembly 100 according to an embodiment of the disclosure may include an air filter 101; 225 and/or a light source module 103; 227. The air filter may have a multi-folded form. The air filter may include a first filter layer 110 having electrostatic adsorption capability and/or a second filter layer 120 stacked on one surface of the first filter layer. The second filter layer may include at least one first region 121 including an ultraviolet photocatalytic material and at least one second region 122 including a visible photocatalytic material. The light source module may include at least one ultraviolet light source 131 facing a portion of the first region and at least one visible light source 132 facing a portion of the second region.

In an embodiment, the ratio of the ultraviolet photocatalytic material to the visible photocatalytic material may be from 19:1 to 3:1.

In an embodiment, the ultraviolet photocatalytic material may include a photocatalytic component including at least one of titanium dioxide (TiO2), tungsten oxide (WO3), or zinc oxide (ZnO), and a hydrophobic gas adsorption component.

In an embodiment, the gas adsorption component may include at least one of HZSM-5, USY, HY, or Beta zeolite.

In an embodiment, the ratio of the photocatalytic component to the gas adsorption component may be from 1:3 to 3:1.

In an embodiment, the visible photocatalytic material may include a compound of the photocatalytic component including at least one of titanium dioxide (TiO2), tungsten oxide (WO3), or zinc oxide (ZnO), and an antibacterial component including at least one of copper (Cu), copper oxide, carbon (C), nitrogen (N), or a copper-zinc alloy (CU—Zn).

In an embodiment, the at least one ultraviolet light source includes a plurality of ultraviolet light sources disposed at regular intervals. The at least one visible light source include a plurality of visible light sources disposed at regular intervals such that each of the plurality of visible light sources is located between a pair of the plurality of ultraviolet light sources.

In an embodiment, a number of the at least one ultraviolet light source is the same as a number of the at least one visible light source.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A purification device comprising:

an air filter having a multi-folded form and comprising:

a first filter layer having electrostatic adsorption capability, and a second filter layer which is stacked on one surface of the first filter layer and comprises:

at least one first region comprising an ultraviolet photocatalytic material and free of a visible photocatalytic material, and at least one second region comprising a visible photocatalytic material and free of an ultraviolet photocatalytic material; and a light source module comprising:

a plurality of ultraviolet light sources disposed at regular intervals to face a portion of the first region of the second filter layer and not to face the at least one second region, and a plurality of visible light sources disposed to face a portion of the second region of the second filter layer and not to face the at least one first region, each of the plurality of visible light sources disposed between a pair of adjacent ultraviolet light sources.

2. The purification device of claim 1, wherein a ratio of the ultraviolet photocatalytic material of the at least one first region of the second filter layer to the visible photocatalytic material of the at least one second region of the second filter layer ranges from 19:1 to 3:1.

3. The purification device of claim 1, wherein the ultraviolet photocatalytic material of the at least one first region of the second filter layer comprises:

a photocatalytic component comprising at least one of titanium dioxide (TiO2), tungsten oxide (WO3), or zinc oxide (ZnO); and a hydrophobic gas adsorption component.

4. The purification device of claim 3, wherein the hydrophobic gas adsorption component comprises at least one of HZSM-5, USY, HY, or Beta zeolite.

5. The purification device of claim 3, wherein a ratio of the photocatalytic component to the hydrophobic gas adsorption component ranges from 1:3 to 3:1.

6. The purification device of claim 1, wherein the visible photocatalytic material of the at least one second region of the second filter layer comprises a compound of:

a photocatalytic component comprising at least one of titanium dioxide (TiO2), tungsten oxide (WO3), or zinc oxide (ZnO); and an antibacterial component comprising at least one of copper (Cu), copper oxide, carbon (C), nitrogen (N), or a copper-zinc alloy (CU-Zn).

7. The purification device of claim 1, wherein the first filter layer is formed by extruding a thermoplastic polymeric material, and wherein the polymeric material comprises a material comprising at least one of polyethylene terephthalate (PET), polypropylene (PP), polyethylene (PE), or polytetrafluoroethylene (PTFE).

8. The purification device of claim 1, wherein the second filter layer comprises a material comprising at least one of a nonwoven fabric, felt, polyethylene terephthalate (PET), or polypropylene (PP).

9. The purification device of claim 1, wherein the at least one first region and the at least one second region are disposed not to overlap each other in a single layer of the second filter layer.

10. The purification device of claim 1, wherein the second filter layer comprises multiple filter layers, and wherein each of the at least one first region of the second filter layer and the at least one second region of the second filter layer are disposed on at least partially on at least one of multiple filter layers of the second filter.

11. The purification device of claim 1, wherein the second filter layer comprises:

a first sublayer, wherein at least one first region of the second filter layer disposed in the first sublayer, and a second sublayer, wherein at least one second region of the second filter layer disposed in the second sublayer, and wherein the first sublayer is more adjacent to the light source module than the second sublayer.

12. The purification device of claim 1, wherein a ratio of the plurality of ultraviolet light sources to the plurality of visible light sources ranges from 1:3 to 3:1.

13. The purification device of claim 1, wherein at least one of the first filter layer or the second filter layer comprises:

at least one of an antibacterial material comprising a metal component comprising at least one of copper (Cu), silver (Ag), or zinc (Zn), or a compound of the metal component; or a dehumidification material comprising at least one of silica, silica gel, zeolite, or a metal-organic framework (MOF).

14. The purification device of claim 1, wherein the air filter further comprises a third filter layer disposed between the first filter layer and the second filter layer, and wherein the third filter layer comprises at least one of:

an adsorbent material comprising at least one of zeolite, sepiolite, mesoporous SiO2, or activated carbon, or a gas adsorption component comprising at least one of silica, silica gel, zeolite, or a metal-organic framework (MOF).

15. The purification device of claim 1, further comprising:

a housing configured to accommodate the air filter and the light source module; and a blowing fan disposed in the housing and configured to introduce outside air into the housing through the air filter.

* * * * *